US006345824B1

(12) United States Patent
Selitzky

(10) Patent No.: US 6,345,824 B1
(45) Date of Patent: Feb. 12, 2002

(54) BONUS FEATURE FOR CASINO CARD GAME

(75) Inventor: Robert Selitzky, Las Vegas, NV (US)

(73) Assignee: R & G Enterprises, Las Vegas, NV (US)

( * ) Notice: Subject to any disclaimer, the term of this patent is extended or adjusted under 35 U.S.C. 154(b) by 3 days.

(21) Appl. No.: 09/591,893

(22) Filed: Jun. 12, 2000

(51) Int. Cl.[7] ..... A63F 1/00

(52) U.S. Cl. ..... 273/292; 273/309; 273/305; 273/274; 463/12; 463/13

(58) Field of Search ..... 273/292, 303, 273/305, 274, 138.2, 309; 463/12, 13, 9, 16

(56) References Cited

U.S. PATENT DOCUMENTS

| | | | | | |
|---|---|---|---|---|---|
| 5,288,077 | A | | 2/1994 | Jones | |
| 5,577,731 | A | | 11/1996 | Jones | |
| 5,615,888 | A | | 4/1997 | Lofink et al. | |
| 5,632,485 | A | * | 5/1997 | Woodland et al. | 273/292 |
| 5,636,843 | A | * | 6/1997 | Roberts | 273/292 |
| 5,713,573 | A | * | 2/1998 | Nazaryan | 273/292 |
| 5,743,530 | A | * | 4/1998 | Sklad et al. | 273/274 |
| 5,806,846 | A | * | 9/1998 | Lofink et al. | 273/292 |
| 5,816,575 | A | | 10/1998 | Keller | |
| 5,839,730 | A | | 11/1998 | Pike | |
| 5,911,419 | A | * | 6/1999 | Delaney et al. | 273/292 |
| 5,944,314 | A | * | 8/1999 | Stavinsky | 273/292 |
| 5,957,459 | A | * | 9/1999 | Chae | 273/292 |
| 5,984,308 | A | * | 11/1999 | Herrmann | 273/292 |
| 5,997,002 | A | * | 12/1999 | Goldman | 273/292 |
| 6,095,525 | A | * | 8/2000 | Terminel | 273/274 |
| 6,154,131 | A | * | 11/2000 | Jones, II et al. | 340/540 |
| 6,196,548 | B1 | * | 3/2001 | Schaefer | 273/292 |
| 6,206,375 | B1 | * | 3/2001 | Wichinsky | 273/292 |
| 6,227,969 | B1 | * | 5/2001 | Yoseloff | 463/13 |

* cited by examiner

*Primary Examiner*—Jeanette Chapman
*Assistant Examiner*—Dolores R. Collins
(74) *Attorney, Agent, or Firm*—Robert Ryan Morishita Anderson & Morishita

(57) ABSTRACT

A bonus method for a base casino card game, such as Blackjack or Baccarat, begins with the player making an ante wager and a first and second bonus wager. The player and dealer are each dealt a hand of cards, or electronic representations thereof. The player plays the player's hand to completion and is rewarded based on the player's first bonus wager if the player's hand includes a predetermined bonus combination. The values of the cards are then summed according to the rules of the base game and the player's ante wager is resolved by comparing a player's hand value with the hand value of the dealer and determining which hand is closest to a target value. Finally, the player's second bonus wager is resolved by rewarding the player if the player has won both the base game and the first bonus wager. If the player loses the base game or does not have a bonus combination, the player's second bonus wager is collected.

13 Claims, 2 Drawing Sheets

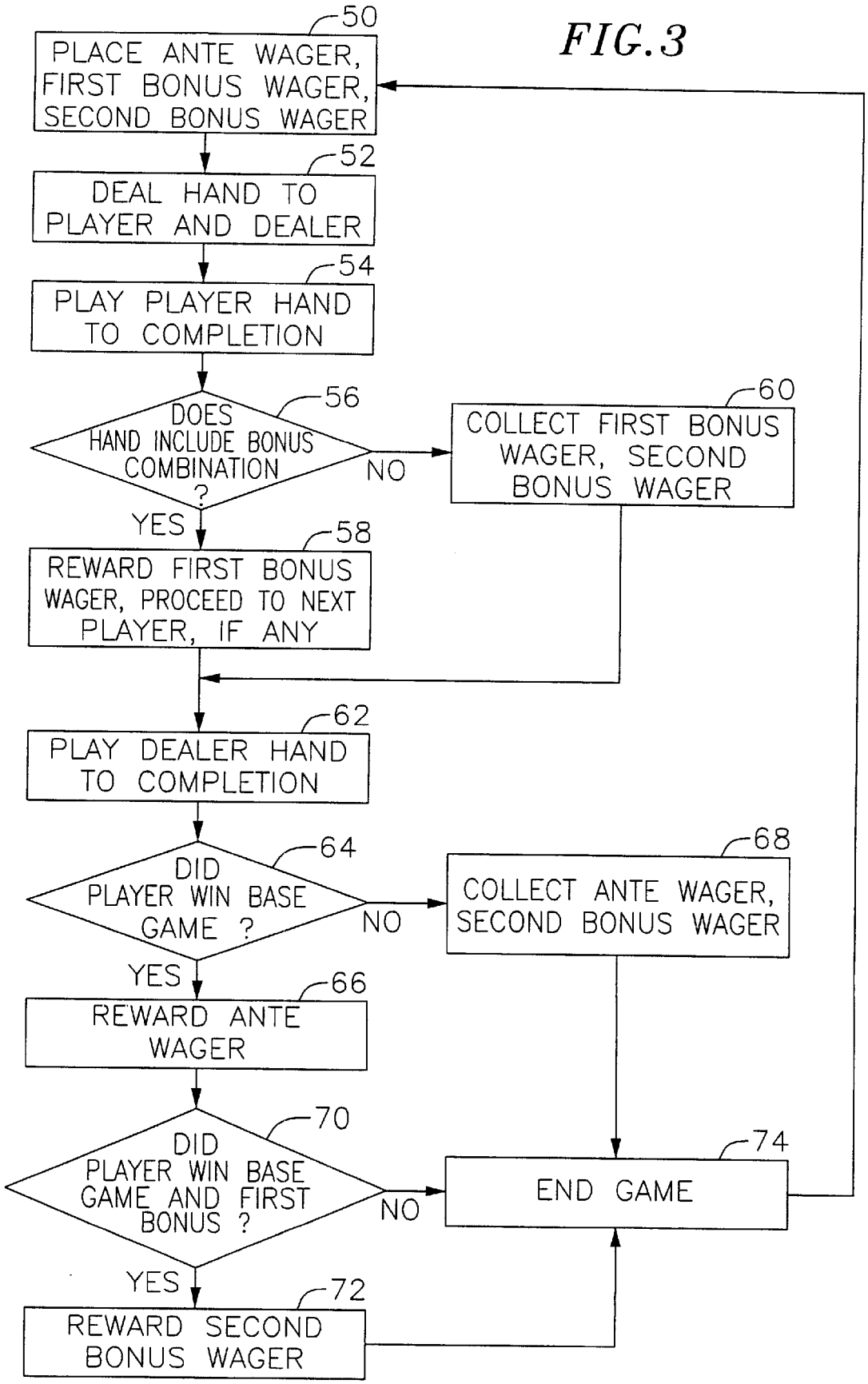
FIG. 3
50
PLACE ANTE WAGER, FIRST BONUS WAGER, SECOND BONUS WAGER
52
DEAL HAND TO PLAYER AND DEALER
54
PLAY PLAYER HAND TO COMPLETION
56
DOES HAND INCLUDE BONUS COMBINATION ?
NO
YES
60
COLLECT FIRST BONUS WAGER, SECOND BONUS WAGER
58
REWARD FIRST BONUS WAGER, PROCEED TO NEXT PLAYER, IF ANY
62
PLAY DEALER HAND TO COMPLETION
64
DID PLAYER WIN BASE GAME ?
NO
YES
68
COLLECT ANTE WAGER, SECOND BONUS WAGER
66
REWARD ANTE WAGER
70
DID PLAYER WIN BASE GAME AND FIRST BONUS ?
NO
YES
74
END GAME
72
REWARD SECOND BONUS WAGER

BONUS FEATURE FOR CASINO CARD GAME

FIELD OF THE INVENTION

The present invention relates to casino card games. Specifically the present invention is a bonus feature casino card games that offers wagers dependent on the outcome of base game as well as wagers independent of the outcome of the base game.

BACKGROUND OF THE INVENTION

Many casino games include players playing against the casino to obtain a player hand having a value closer to a target value than the house hand. For example, Baccarat, Blackjack, Spanish Twenty-One, and the like all fit this pattern.

Blackjack is a well known card game played in casinos. The object of the game is to have a final hand total as close to twenty-one as possible without exceeding twenty-one. For purposes of calculating the final hand total, each card has a value equal to its face value except face cards, which have a value of ten, and aces, which may have a value of eleven or one as the player selects. In conventional Blackjack, the suit of the cards is irrelevant.

The form of Blackjack played in casinos is played between a dealer, representing the house, and at least one player. In a typical Blackjack game, each player makes a wager in a wagering area on a playing surface. The dealer deals two cards to each player and two cards, one card face up and the other face down, to himself or herself. Any player receiving a natural twenty-one or Blackjack, i.e. a total of twenty-one in the initial dealt hand, is immediately rewarded, typically at a rate of 2:1 or 3:2, and play is terminated as to that player. Each remaining player examines the player's hand and decides whether to hit, i.e. receive another card, or stand, i.e. stand on the player's current hand. A player may hit as many times as the player wishes as long as the player does not bust, i.e. have a cumulative total greater than twenty-one. When a player busts, the player's wager is immediately collected and play is terminated as to that player.

A player may also have additional options available depending on the initial hand dealt. If the player receives a pair, i.e. two cards having the same face value, the player may split the pair and use each card as a basis for a separate hand. For example, if a player were to be dealt a pair of eights, the player may choose to split the pair and continue play with two hands each having an eight and an additional dealt card. Each of those individual hands is then played independently.

A player may also have the option to double down. Although the availability of the double down option vary from casino to casino, the option allows a player to double the player's wager in exchange for a single additional card.

After all the players have played their hands, the dealer reveals the face-down card in the dealer's hand. The dealer plays the dealer's hand according to established house rules. That is, the casino uses established rules to eliminate the dealer's discretion hits or stands as the house rules dictate, and resolves the wagers. In resolving the wagers, players with a final hand total closer to twenty-one than the dealer's final hand total are rewarded at 1:1. Conversely, wagers are collected from players with a final hand total further from twenty-one than the dealer's final hand total. If the dealer busts, all players who did not bust or receive a Blackjack are rewarded. If the player and dealer push, i.e. have the same final hand total, the player's wager is returned.

It is known in the art that players are drawn to new features on conventional games, especially when those features lead to higher or more frequent payouts. One method for a player to increase the excitement and potential win for the player is for the player to make an additional wager to participate in a bonus feature. For example, U.S. Pat. No. 5,839,730, issued to Pike, discloses a side wager for Blackjack in which players are immediately rewarded for obtaining card sequences independent and separate from the Blackjack game. The winning bonus sequence may include only two cards, such as a pair of cards or adjacent cards, or it may include multiple cards. The player may earn a bonus reward even if he or she loses the Blackjack game itself.

However, the game of Pike has drawbacks. First, the payouts are cumulative in that a reward is issued when the player receives the first and second card of the sequence and separate rewards are issued as the player "hits" and receives the other cards of the sequence. That is, a player may be issued a first reward for receiving two aces. If the player hits and receives a third ace, he is rewarded again, and so forth. This can create a burden on the casino because the dealer must examine each player's hand after each hit to determine whether a bonus hand has been obtained and issue a reward accordingly.

Another drawback of Pike is that player are required to select from a plurality of bonus outcomes. In other words, a player must wager separately on multiple, mutually exclusive bonus outcomes for each hand. This can be burdensome on the player because the player must wager a great deal of money to cover all possible bonus outcomes. Also, because a player is unlikely to wager on all possible bonus outcomes for every game, bonus payouts are likely to be infrequent.

Similarly, U.S. Pat. No. 5,288,077, to Jones, discloses a side wager for black jack in which players receive a progressive jackpot reward for receiving a variety of hands including straights, suited combinations, and the like. U.S. Pat. No. 5,577,731, also to Jones, likewise discloses a side wager for Blackjack in which players receive a progressive jackpot reward for receiving three aces during the play of the player's hand. The drawbacks to Jones '077 and Jones '731 are that the progressive payouts must be tracked by the dealer and carried over to each successive game. Again, this can be a burden on the dealer and reduce his or her efficiency and number of games dealt per time period.

Lofink, U.S. Pat. No. 5,615,888 also discloses a game in which a bonus is paid for receiving various combinations of cards that add to twenty-one, such as three sevens, three suited sevens, six-seven-eight, and so forth. However, bonus payouts will be infrequent in such a bonus scheme because the only bonus combinations disclosed add to twenty-one. Also, there is no added excitement for the player because a sum of twenty-one already guarantees the player at least a push.

Thus, it can be seen that there is a need in the art for a new game that is based on conventional Blackjack, which is well known and easy to learn, yet provides the opportunity for frequent bonus payouts for obtaining certain hands.

SUMMARY OF THE INVENTION

A method for providing a bonus for a base casino card game begins with a player making an ante wager to participate in the game and first and second bonus wagers to participate in the bonus feature. The base game of the present invention is of the type in which a player plays against a dealer using standard playing cards or electronic representations thereof. The dealer may be a person or the player may play against a gaming machine representing a dealer. The player and a dealer are each dealt a hand of cards. The player may optionally select to receive additional cards.

The first bonus wager is resolved by comparing the cards of the player's hand to a predetermined set of bonus combinations. The bonus combinations may optionally be limited to four or fewer cards. The bonus combinations may optionally include one or more of the following: Designated Card, Face Card, One Pair, Three of a Kind, Four of a Kind, and Suited Four of a Kind. If the player's hand contains one of the bonus combinations, the player is rewarded. Alternatively, if the player's hand does not contain one of the bonus combinations, both the first and second bonus wagers are collected. That is, the player cannot win the second bonus wager unless he has won the first bonus wager.

Optionally, the dealer's play may be governed by established house rules. The values of the dealer's hand and the player's hand are summed according to the rules of the game, and the player's ante wager is resolved by comparing a player's hand value with the hand value of the dealer and determining which hand is closest to a target value.

The second bonus wager is resolved by rewarding the player if the player hand contains one of the bonus combinations and the player has a player hand value closer to the target value than the dealer. That is, the player is rewarded only if the player wins both the base game and the first bonus wager. If the player loses the base game, for example by exceeding the target value or by having a player hand value further from the target value than the dealer, or if the player loses the first bonus wager by having a player hand that does not contain one of said bonus combinations, the player's second bonus wager is collected. Optionally, the second bonus wager is paid at 3 to 1.

In an optional embodiment, a gaming machine may represent a dealer and electronic representations of standard playing cards may be used. In such an embodiment, the gaming machine includes a data processor communicating with a data structure and a display. The method begins with the player making an ante wager, a first bonus wager, and a second bonus wager. In response, the data processor deals a two-card hand to the player and the dealer and displays the player's hand and one of the dealer's cards at the display. The player elects to receive additional cards or stand on the two-card hand. The data processor resolving the player's first bonus wager by comparing the cards of the player's hand to a predetermined set of bonus combinations stored in the data structure. Optionally, each bonus combination comprises four or fewer cards. The player is rewarded if the player's hand contains one of said bonus combinations. In an optional embodiment, the reward is issued for the highest ranking bonus combination only. Alternatively, the player's first and second bonus wagers are collected if the player's hand does not contain one of said bonus combinations.

The data processor deals additional cards to the dealer according to the house rules stored in said data structure, then resolves the player's ante wager by comparing the player's hand value with the dealer's hand value. For example, in Blackjack, the player is rewarded based on the ante wager if the player's hand value is closer to twenty-one than the dealer or if the dealer's hand value exceeds the target value. Conversely, the player's ante wager and second bonus wager are collected if the dealer's hand value is closer to twenty-one than the player or if the player's hand value exceeds twenty-one.

The player's second bonus wager is resolved by rewarding the player if the player hand contains one of the bonus combinations and has a hand value closer to twenty-one than the dealer or collecting the player's second bonus wager if (1) the player's hand does not contain one of said bonus combinations or (2) the player loses the base game. For example, in Blackjack, the player may lose the base game by having a player's hand value that exceeds twenty-one or if the dealer's hand value is closer to twenty-one than the player hand value. Optionally, the second bonus wager is paid at 3 to 1.

It is an object of the present invention to provide a bonus payout for a base casino card game that includes components that are dependent on the outcome of the base game and independent of the outcome of the base game.

BRIEF DESCRIPTION OF THE DRAWINGS

FIG. 3 is a flow chart of an embodiment of the method of the present invention.

DESCRIPTION

Reference is now made to the figures wherein like parts are referred to by like numerals throughout. The present invention is a casino card game and bonus method for a casino card game. The present casino card game and bonus method includes a table game embodiment and an electronic embodiment.

Figure 1:
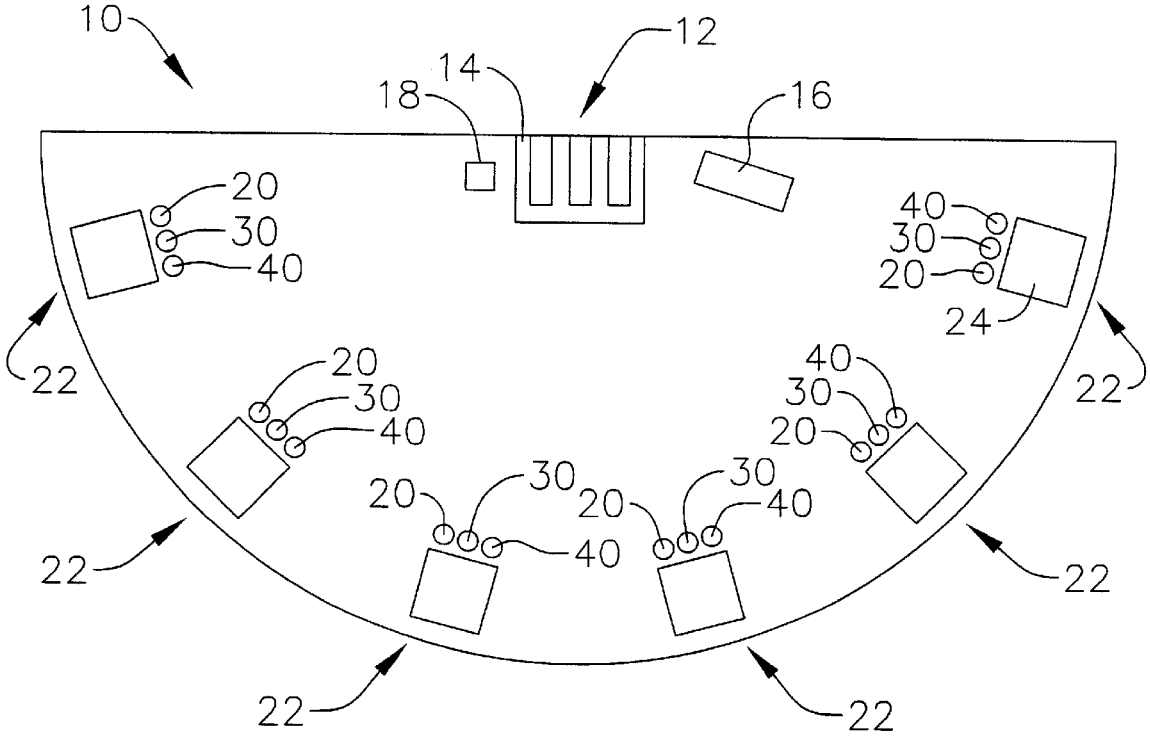
FIG. 1 is a top view of a layout according to an embodiment of the present invention.

The table game embodiment of the present casino card game is optionally played on a table layout 10 such as that shown in FIG. 1. The table layout 10 includes a dealer position 12 and a plurality of player positions 22. The dealer position 12 optionally includes a check tray 14 for holding gaming chips, a deck of cards or a shoe 16 holding one or more decks of cards, and a discard tray 18 to hold cards after they have been played.

While the number of player positions 22 may vary, conventional Blackjack table layouts include six player positions 22. On the table layout 10 shown in FIG. 1, each player position 22 includes three wagering areas 20, 30, 40. Optionally, the table layout 10 may additionally include paytables 24 at each player position 22 listing the bonus combinations of the game as described below.

Figure 2:
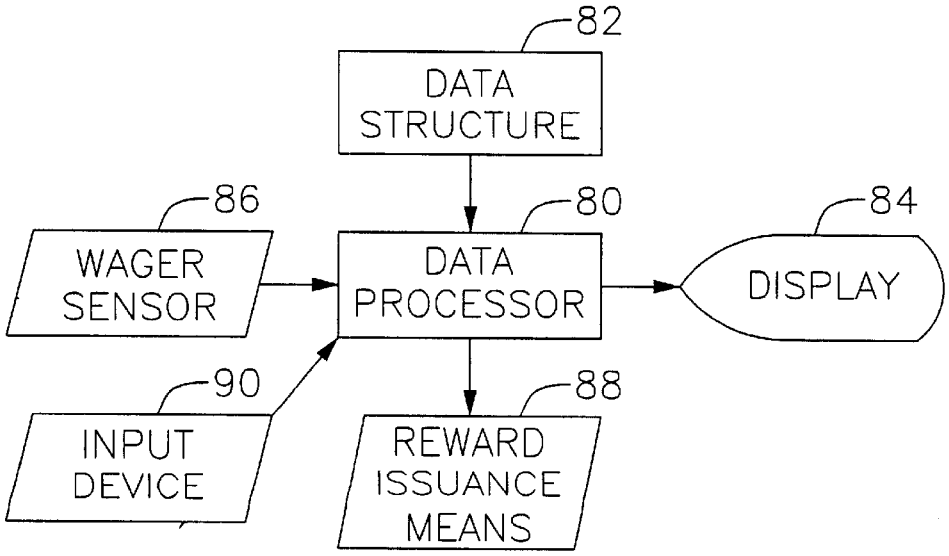
FIG. 2 is a block diagram of a gaming machine according to an embodiment of the present invention.

In an alternate embodiment, the present casino card game and bonus method may be played on a gaming machine like that shown in FIG. 2. In such an embodiment, a data processor 80 communicates with at least one data structure 82 storing programming instructions for the data processor 80 as well as data tables including paytables, bonus combinations, card representations, and the like. The data processor 80 also communicates with a display 84 and a bet sensor 86 that senses when a wager is placed at the gaming machine. Additionally the data processor communicates with, and controls, a means for issuing a reward 88.

Referring to FIG. 3, the casino card game and bonus method of the present invention is played between a player and a dealer using one or more decks of standard playing cards. In a gaming machine embodiment, electronic representations of standard playing cards stored in a data structure 82 may be used instead of one or more physical decks of cards. As stated above, the dealer may be a person in a table game embodiment or may be represented by a gaming machine in a gaming machine embodiment.

The casino card game of the present invention includes a base game and bonus features. The base game is of the type in which a winner is determined by comparing the player's hand and a dealer's hand to a target value and rewarding the player if the player hand value is closer to the target value than the dealer's hand value. Examples of games that can serve as a base game for the present invention include Baccarat; Blackjack, or any of the variations on Blackjack; or the like.

The game and bonus method begins with each player placing 50 an ante wager, a first bonus wager, and a second bonus wager. The dealer deals 52 hands to each player and to the dealer. In the case of Blackjack, one of the dealer's cards is displayed and the other is concealed.

In turn, each player plays 54 his or her hand to completion by receiving additional cards, if allowed under the rules of the base game, or standing on the player's initial hand. For example, in Blackjack, a player may hit or stand as that player desires. Conversely, in Baccarat, a player's options are more limited. Likewise, if the base game is Blackjack, the player may have a natural or Blackjack, i.e. a hand value of twenty-one in the initial two card hand. In this case, the player's ante wager is immediately rewarded. In playing the player's hand to completion 54, the player may obtain an automatically losing outcome, such as having a hand value that exceeds twenty-one in Blackjack. Even if the player loses, the player remains eligible to win the first bonus wager. If an automatically losing outcome is obtained, the ante wager and second bonus wager are collected, however.

After the player completes the player's hand, the dealer examines the player's hand to determine 56 whether the player's hand includes one of the predetermined bonus combinations. If the player's hand includes at least one bonus combination, the player is rewarded 58 based on the player's first bonus wager. If a player's hand includes more than one bonus combination, the player is rewarded for the highest bonus combination only. If a player's hand does not include any bonus combinations, the first bonus wager and second bonus wager are collected.

Any set of bonus combinations may be used, however, in an optional embodiment, the bonus combinations are limited to four or fewer cards to reduce the burden on the dealer while maintaining the possibility of large bonus rewards. In other words, the bonus awards are structured to allow the dealer to quickly determine whether a player has a bonus combination and how much the player should be rewarded. For example, in an optional embodiment, the bonus combinations and awards contemplated may include those shown in Table 1.

TABLE 1

| Bonus Combination | Payout |
|---|---|
| Suited Four of a Kind | Highest |
| Four of a Kind | Second highest |
| Three of a Kind | Third highest |
| One Pair | Fourth highest |
| Face Card | Fifth highest |
| Designated Card | Lowest |

As an example, Suited Four of a Kind may be rewarded at 5,000 to 1; Four of a Kind at 500 to 1; Three of a Kind at 50 to 1; Pair at 5 to 1; Face Card at 4 to 1; and Designated Card at 1 to 1. The house may optionally institute a rule capping bonus rewards or requiring that the first bonus wager not exceed a predetermined ratio with respect to the ante wager.

During completion 54 of the player's hand, the player may have the option to form additional hands, such as by splitting in Blackjack. In this situation, the house may optionally institute a rule disqualifying the player from winning further bonus wagers. That is, if one of the bonus combinations is a pair, a player who chooses to split a pair is rewarded for obtaining a pair but will not be rewarded for obtaining further bonus combinations in the sub-hands created.

After all the players have played their hands to completion, the dealer plays 62 his or her hand to completion. The dealer's play may be constrained by established house rules such as those used in Blackjack or the rules of the game such as those used in Baccarat. Upon completion 62 of the dealer's hand, the dealer resolves the ante wagers by determining 64 which players won the base game. Players winning the base game are rewarded 66 based on their ante wagers. Conversely, ante wagers and second bonus wagers are collected 68 from players losing the base game.

For example, in Blackjack, the ante wagers are resolved 64 by summing the cards of each player's hand and the dealer's hand using the face value on each number card, ten for face cards, and eleven or one for aces. The dealer then compares each player's hand value and the dealer's hand to the target value twenty-one. Players having hand values closer to twenty-one than the dealer are rewarded 66 and players having hand values further from twenty-one than the dealer lose 68 their ante wager and their second bonus wager. The ante wager is optionally rewarded at the same rate as the conventional base game.

For each player, the second bonus wager is then resolved. Each player who won both the base game and the first bonus wager is rewarded based on the second bonus wager. That is, the second bonus wager is paid only if the player has a bonus combination and wins the base game. For example, in Blackjack, the player is rewarded based on the second bonus wager if the player has a bonus combination and (1) has a hand value closer to the target value twenty-one than the dealer or (2) the dealer busts. Thus, it can be seen that the first bonus wager is independent of the outcome of the base game while the second bonus wager is dependent upon the outcome of the base game. Although the second bonus wager could be rewarded in any fashion, in an optional embodiment, the second bonus wager is paid at 3 to 1.

With reference to FIGS. 2 and 3, the game and bonus method of the present invention may also be played on gaming machine with the gaming machine representing the dealer. For example, the gaming machine may be a personal computer, a video gaming machine, or the like. Moreover, the present gaming method may be played over computer networks such as interconnected gaming machines, the Internet, or the like. In such an embodiment, the method begins with the player placing 50 an ante wager and first and second bonus wagers. The gaming machine may optionally have a means for receiving the wager, such as a bill or coin acceptor, coupled to a bet sensor 86 that senses the wagers. Upon receipt of a signal from the bet sensor 86 indicating that a wager has been received, the processor 80 begins play of the game by randomly selecting cards from those stored in the data structure 82 and dealing 52 a hand of cards to each player and the dealer. The processor 80 displays the player's hand and, in the case of Blackjack one of the dealer's cards, at the display 84. The player plays 54 the player hand to completion by issuing instructions through an input device 90. The input device 90 may be a button, keypad, keyboard, or the like.

Upon completion of the player hand, the processor compares 56 the player's hand to a set of predetermined bonus combinations. If the player's hand includes one or more bonus combinations, the player is rewarded 58 based on the player's first wager. Alternatively, if the player's hand does not include a bonus combination, the player's first and second bonus wager is collected 60 and retained by the gaming machine. Optionally, when the player loses his first bonus wager, the first bonus wager, or a portion thereof, may be allocated to a progressive jackpot that is awarded the next successive time the first bonus wager is won. As above, if the player's hand includes more than one bonus combination, only the highest ranking bonus combination is rewarded.

The processor completes 62 the dealer's hand according to the rules of the base game and resolves 64 each player's ante wager. If the player wins the base game, the player is rewarded 66 based on the player's ante wager. Conversely, if the player loses the base game, the player's ante wager is collected 68.

The second bonus wager is also resolved 70. For each player winning the base game and winning the first bonus wager, the second bonus wager is rewarded 72. If a player loses the base game or does not receive a bonus combination, the player's second bonus wager is collected 74 and retained by the gaming machine. As above, the second bonus wager may be paid at 3 to 1.

The gaming machine optionally includes means for issuing a reward 90 that issues the reward after all wagers are resolved. The reward issuance means 90 may include a coin dispenser, a bill dispenser, a scrip dispenser, a printer, or the like. Similarly, the gaming machine may issue a reward by crediting a player's account, credit card, or the like.

While certain embodiments of the present invention have been shown and described it is to be understood that the present invention is subject to many modifications and changes without departing from the spirit and scope of the description presented herein.

I claim:

1. A method for providing a bonus for a base casino card game of the type in which a player makes an ante wager to participate in the game, the player and a dealer are dealt a hand of cards, or electronic representations thereof, the values of which are summed according to the rules of the base game, and the player's ante wager is resolved by comparing a player's hand value with the hand value of the dealer and determining which hand is closest to a target value, the bonus method comprising:

the player making a first bonus wager and a second bonus wager;

resolving the player's first bonus wager by comparing the cards of the player's hand to a predetermined set of bonus combinations and rewarding the player if the player's hand contains one of said bonus combinations or collecting the player's first and second bonus wagers if the player's hand does not contain one of said bonus combinations; and resolving the player's second bonus wager by rewarding the player if the player's hand contains one of said bonus combinations and the player wins the base game, or collecting the player's second bonus wager if the player loses the base game or does not have a player hand containing one of said bonus combinations.

2. The method of claim 1 wherein each of said bonus combinations comprise four or fewer cards.

3. The method of claim 2 wherein said bonus combinations comprise the group consisting of: Designated Card, Face Card, and One Pair.

4. The method of claim 3 wherein said bonus combinations further comprise the group consisting of: Three of a Kind, Four of a Kind, and Suited Four of a Kind.

5. The method of claim 1 wherein said base game is Blackjack.

6. The method of claim 1 wherein said base game is Baccarat.

7. A method for providing a bonus for a Blackjack game using standard playing cards between a dealer playing according to established house rules and a player, comprising:

the player making an ante wager, a first bonus wager, and a second bonus wager;

the player and the dealer receiving a two-card hand;

the player electing to receive additional cards or stand on the two-card hand;

resolving the player's first bonus wager by comparing the cards of the player's hand to a predetermined set of bonus combinations, each bonus combination comprising four or fewer cards, and rewarding the player if the player's hand contains one of said bonus combinations, the reward issued for the highest ranking bonus combination only, or collecting the player's first and second bonus wagers if the player's hand does not contain one of said bonus combinations;

the dealer receiving additional cards according to the house rules;

summing the values of the cards;

resolving the player's ante wager by comparing a player's hand value with the dealer's hand value and rewarding the player if the player's hand value is closer to twenty-one than the dealer or collecting the player's ante wager and second bonus wager if the dealer's hand value is closer to twenty-one than the player or if the player's hand value exceeds twenty-one; and resolving the player's second bonus wager by rewarding the player if the player hand contains one of said bonus combinations and has a hand value closer to twenty-one than the dealer or the dealer has a hand value greater than twenty-one, or collecting the player's second bonus wager if (1) the player's hand does not contain one of said bonus combinations, (2) the player's hand value exceeds twenty-one, or (3) the dealer's hand value is closer to twenty-one than the player.

8. The method of claim 7 wherein said bonus combinations comprise the group consisting of: Designated Card, Face Card, and One Pair.

9. The method of claim 8 wherein said bonus combinations further comprise the group consisting of: Three of a Kind, Four of a Kind, and Suited Four of a Kind.

10. A method for providing a bonus for a Blackjack game using electronic representations of standard playing cards between a gaming machine representing a dealer playing according to established house rules and a player, the gaming machine including a data processor communicating with a data structure and a display, the method comprising:

the player making an ante wager, a first bonus wager, and a second bonus wager;

the data processor dealing a two-card hand to the player and the dealer and displaying the player's hand at the display;

the player electing to receive additional cards or stand on the two-card hand;

the data processor resolving the player's first bonus wager by comparing the cards of the player's hand to a predetermined set of bonus combinations stored in said data structure, each bonus combination comprising four or fewer cards, and rewarding the player if the player's hand contains one of said bonus combinations, the reward issued for the highest ranking bonus combination only, or collecting the player's first and second bonus wagers if the player's hand does not contain one of said bonus combinations;

the data processor dealing additional cards to the dealer according to the house rules stored in said data structure;

the data processor summing the values of the cards;

the data processor resolving the player's ante wager by comparing the player's hand value with the dealer's hand value and rewarding the player if the player's hand value is closer to twenty-one than the dealer or collecting the player's ante wager and second bonus wager if the dealer's hand value is closer to twenty-one than the player or if the player's hand value exceeds twenty-one; and resolving the player's second bonus wager by rewarding the player if the player hand contains one of said bonus combinations and has a hand value closer to twenty-one than the dealer or the dealer has a hand value greater than twenty-one, or collecting the player's second bonus wager if (1) the player's hand does not contain one of said bonus combinations, (2) the player's hand value exceeds twenty-one, or (3) the dealer's hand value is closer to twenty-one than the player.

11. The method of claim 10 wherein said bonus combinations comprise the group consisting of: Designated Card, Face Card, and One Pair.

12. The method of claim 11 wherein said bonus combinations further comprise the group consisting of: Three of a Kind, Four of a Kind, and Suited Four of a Kind.

13. The method of claim 10 additionally comprising the steps of the data processor accruing the player's second bonus wager in a progressive jackpot when the second bonus wager is collected and awarding to the player the progressive jackpot when the second bonus wager is won.

* * * * *